US009728123B2

(12) United States Patent
Kim et al.

(10) Patent No.: US 9,728,123 B2
(45) Date of Patent: Aug. 8, 2017

(54) ORGANIC LIGHT EMITTING DISPLAY DEVICE AND METHOD OF DRIVING THE SAME

(71) Applicant: Samsung Display Co., Ltd., Yongin, Gyeonggi-Do (KR)

(72) Inventors: Il-Nam Kim, Yongin (KR); Won-Sang Park, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 581 days.

(21) Appl. No.: 14/165,369

(22) Filed: Jan. 27, 2014

(65) Prior Publication Data

US 2015/0009194 A1 Jan. 8, 2015

(30) Foreign Application Priority Data

Jul. 8, 2013 (KR) ..... 10-2013-0079494

(51) Int. Cl.
*G09G 3/3233* (2016.01)
*G09G 3/20* (2006.01)

(52) U.S. Cl.
CPC ..... *G09G 3/3233* (2013.01); *G09G 3/2003* (2013.01); *G09G 2300/0452* (2013.01); *G09G 2300/0819* (2013.01); *G09G 2300/0861* (2013.01)

(58) Field of Classification Search
CPC ..... G09G 3/3233; G09G 2300/0861; G09G 2300/0819; G09G 2300/0452; G09G 3/2003
See application file for complete search history.

(56) References Cited

U.S. PATENT DOCUMENTS

2006/0262130 A1* 11/2006 Kim ..... G09G 3/3233 345/589
2008/0036704 A1* 2/2008 Kim ..... G09G 3/3233 345/76
2009/0128458 A1* 5/2009 Kim ..... G09G 3/3233 345/76
2010/0013824 A1* 1/2010 Kim ..... G09G 3/3266 345/214
2011/0025678 A1* 2/2011 Chung ..... G09G 3/3233 345/213
2012/0147065 A1* 6/2012 Byun ..... G09G 3/3208 345/690
2012/0268357 A1* 10/2012 Shih ..... G09G 3/3607 345/88

FOREIGN PATENT DOCUMENTS

KR 10-2009-0050764 A 5/2009
KR 10-2011-0057234 A 5/2011
WO WO 2010/039938 A1 4/2010

* cited by examiner

*Primary Examiner* — Aneeta Yodichkas
(74) *Attorney, Agent, or Firm* — Lewis Roca Rothgerber Christie LLP

(57) ABSTRACT

An organic light emitting display device includes a plurality of pixels, each including a red sub-pixel, a green sub-pixel, a first blue sub-pixel and a second blue sub-pixel; and an initialization power source configured to supply a plurality of initialization voltages to the pixels, wherein the first and second blue sub-pixels are adjacent to each other and are coupled to a same data line.

17 Claims, 5 Drawing Sheets

ORGANIC LIGHT EMITTING DISPLAY DEVICE AND METHOD OF DRIVING THE SAME

CROSS-REFERENCE TO RELATED APPLICATION

This application claims priority to and the benefit of Korean Patent Application No. 10-2013-0079494, filed on Jul. 8, 2013, in the Korean Intellectual Property Office, the entire contents of which are incorporated herein by reference in their entirety.

BACKGROUND

1. Field

Embodiments of the present invention relate to an organic light emitting display device and a method of driving the same.

2. Description of the Related Art

Flat panel display devices include liquid crystal display devices, field emission display devices, plasma display panels, organic light emitting display devices, and the like.

Among these flat panel display devices, the organic light emitting display device displays images using organic light emitting diodes that emit light through recombination of electrons and holes. The organic light emitting display device has a fast response speed and is driven with low power consumption.

SUMMARY

Embodiments of the present invention provide an organic light emitting display device and a method of driving the same, which may increase (or improve) image quality by using together a first blue organic light emitting diode formed of a light blue organic light emitting material and a second blue organic light emitting diode formed of a dark blue organic light emitting material.

According to an embodiment of the present invention, there is provided an organic light emitting display device including: a plurality of pixels, each including a red sub-pixel, a green sub-pixel, a first blue sub-pixel and a second blue sub-pixel; and an initialization power source configured to supply a plurality of initialization voltages to the pixels, wherein the first and second blue sub-pixels are adjacent to each other and are coupled to a same data line.

Each of the red sub-pixel, the green sub-pixel, the first blue sub-pixel and the second blue sub-pixel may include a driving transistor including a gate electrode configured to receive any one of the plurality of initialization voltages before a data signal is supplied.

The initialization power source may be configured to supply a first initialization voltage to the red and green sub-pixels, a second initialization voltage to the first blue sub-pixel, and a third initialization voltage to the second blue sub-pixel.

The first initialization voltage may be a voltage lower than the data signal.

The initialization power source may be configured to supply a low second initialization voltage lower than the data signal or a high second initialization voltage higher than the data signal.

The initialization power source may be configured to supply a low third initialization voltage lower than the data signal or a high third initialization voltage higher than the data signal.

The first blue sub-pixel may include an organic light emitting diode formed of a sky blue organic light emitting material.

The second blue sub-pixel may include an organic light emitting diode formed of a deep blue organic light emitting material.

The organic light emitting display device may further include a scan driver configured to supply a scan signal to a plurality of scan lines coupled to the pixels at respective horizontal lines and supply an emission control signal to a plurality of emission control lines; and a data driver configured to supply a data signal to a plurality of data lines coupled to the pixels at respective vertical lines.

Each of the red sub-pixel, the green sub-pixel, the first blue sub-pixel and the second blue sub-pixel may include an organic light emitting diode configured to generate light of a corresponding one of red, green and blue; and a pixel circuit configured to control an amount of current supplied to the organic light emitting diode.

Each pixel circuit may include a driving transistor configured to control an amount of current flowing through the organic light emitting diode from a first power source coupled to the driving transistor via a first node; a second transistor coupled between a gate electrode of the driving transistor and the initialization power source, the second transistor being configured to turn on when the scan signal is supplied to a previous scan line of the plurality of scan lines; a third transistor coupled between the gate electrode and a second electrode of the driving transistor, the third transistor being configured to turn on when the scan signal is supplied to a current scan line of the plurality of scan lines; and a fourth transistor coupled between the first node and a data line of the plurality of data lines, the fourth transistor being configured to turn on when the scan signal is supplied to the current scan line.

Each pixel circuit may further include a fifth transistor coupled between the first node and the first power source, the fifth transistor being configured to turn off when the emission control signal is supplied to a current emission control line of the plurality of emission control lines; and a sixth transistor coupled between the second electrode of the driving transistor and the organic light emitting diode, the sixth transistor being configured to turn off when the emission control signal is supplied to the current emission control line.

The emission control signal supplied to the current emission control line may overlap with the scan signal supplied to the previous scan line and the current scan line.

According to another aspect of the present invention, there is provided a method of driving an organic light emitting display device which includes a pixel including a red sub-pixel, a green sub-pixel, a first blue sub-pixel and a second blue sub-pixel, the method including: controlling whether or not the first and second blue sub-pixels sharing a data line emit light; supplying a data signal to the red sub-pixel, the green sub-pixel, the first blue sub-pixel and the second blue sub-pixel; and allowing the sub-pixel set in an emission state by including the red and green sub-pixels to emit light, corresponding to the data signal.

The first blue sub-pixel may include an organic light emitting diode formed of a sky blue organic light emitting material.

The second blue sub-pixel may include an organic light emitting diode formed of a deep blue organic light emitting material.

Each of the red sub-pixel, the green sub-pixel, the first blue sub-pixel and the second blue sub-pixel may include a driving transistor diode-coupled during a period in which the data signal is supplied.

The controlling may include supplying, to a gate electrode of the driving transistor of the first blue sub-pixel, a high second initialization voltage higher than the data signal or a low second initialization voltage lower than the data signal, before the data signal is supplied; and supplying, to a gate electrode of the driving transistor of the second blue sub-pixel, a high third initialization voltage higher than the data signal or a low third initialization voltage lower than the data signal, before the data signal is supplied.

BRIEF DESCRIPTION OF THE DRAWINGS

Example embodiments of the present invention will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments of the present invention to those skilled in the art.

In the drawing figures, dimensions may be exaggerated for clarity of illustration. It will be understood that when an element is referred to as being "between" two elements, it may be the only element between the two elements, or one or more intervening elements may also be present. Like reference numerals refer to like elements throughout.

DETAILED DESCRIPTION

Figure 1:
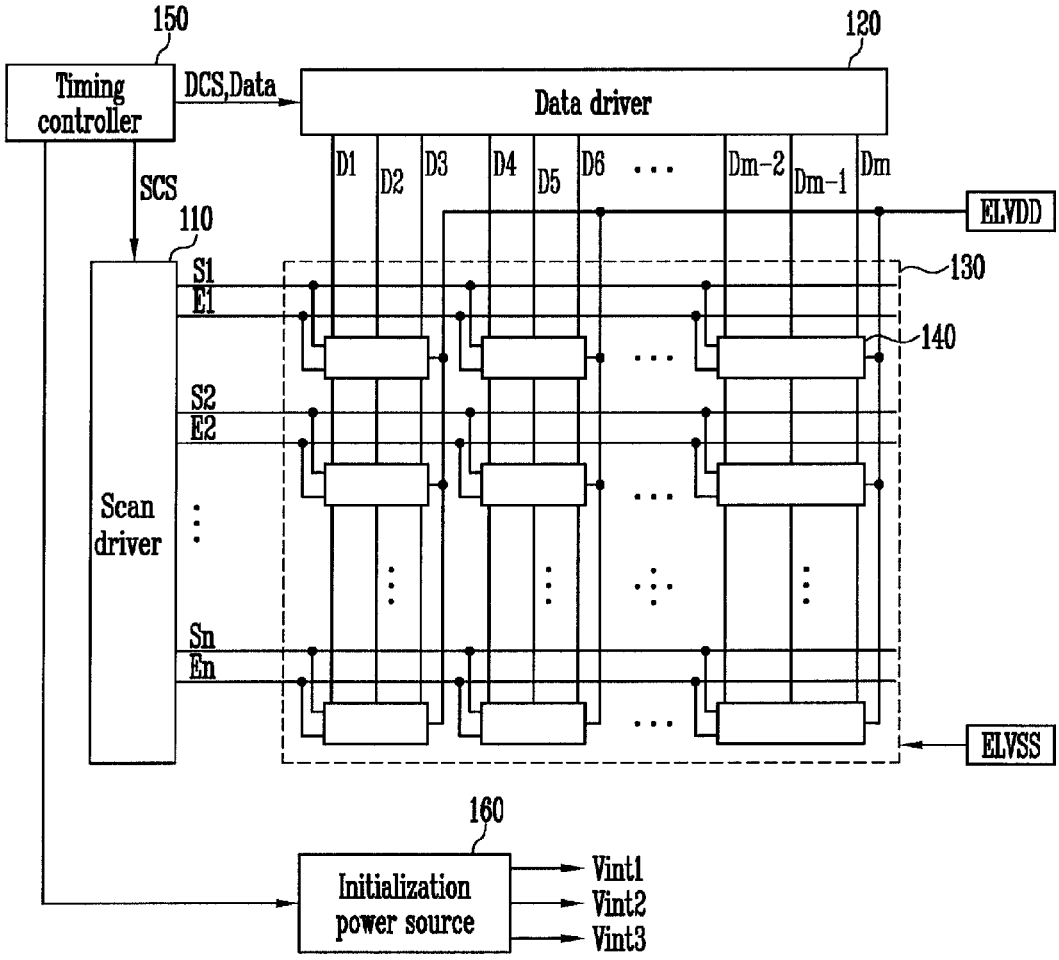
FIG. 1 is a diagram illustrating an organic light emitting display device according to an embodiment of the present invention.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

FIG. 1 is a diagram illustrating an organic light emitting display device according to an embodiment of the present invention.

Referring to FIG. 1, the organic light emitting display device according to this embodiment includes a display unit 130 configured to include pixels 140 positioned in an area defined by scan lines S1 to Sn and data lines D1 to Dm, a scan driver 110 configured to drive the scan lines S1 to Sn and emission control lines E1 to En, a data driver 120 configured to drive the data lines D1 to Dm, an initialization power unit (or initialization power source) 160 configured to generate initialization voltages Vint1, Vint2 and Vint3, and a timing controller 150 configured to control the scan driver 110, the data driver 120 and the initialization power unit 160.

The scan driver 110 receives scan driving control signal SCS supplied from the timing controller 150. The scan driver 110 receiving the scan driving control signal SCS generates a scan signal, and supplies the generated scan signal to the scan lines S1 to Sn. The scan driver 110 generates an emission control signal, in response to the scan driving control signal SCS, and supplies the generated emission control signal to the emission control lines E1 to En. Here, the width of the emission control signal may be set identical to or wider than that of the scan signal. For example, the emission control signal supplied to an i-th (i is a natural number) emission control line Ei is supplied to overlap with the scan signal supplied to (i−1)-th and i-th scan lines Si−1 and Si.

The data driver 120 receives a data driving control signal DCS supplied from the timing controller 150. The data driver 120 receiving the data driving control signal DCS generates a data signal, and supplies the generated data signal to the data lines D1 to Dm, in synchronization with the scan signal.

The display unit 130 includes the pixels 140 positioned in the area defined by the scan lines S1 to Sn and the data lines D1 to Dm. The pixels 140 receive a first power source ELVDD and a second power source ELVSS set to a voltage lower than that of the first power source ELVDD from the outside of the organic light emitting display device.

Each pixel 140 includes a plurality of sub-pixels, e.g., a red sub-pixel, a green sub-pixel, a first blue sub-pixel and a second blue sub-pixel. Each sub-pixel includes a driving transistor and an organic light emitting diode. The driving transistor controls the amount of current flowing from the first power source ELVDD to the second power source ELVSS via the organic light emitting diode, corresponding to the data signal.

In embodiments of the present invention, each sub-pixel allows the driving transistor to be diode-coupled during a period in which the data signal is supplied so that the threshold voltage of the driving transistor may be compensated. To this end, each sub-pixel initializes the voltage at a gate electrode of the driving transistor, using an initialization voltage (any one of Vint1, Vint2 and/or Vint3) before the data signal is supplied.

The timing controller 150 generates the data driving control signal DCS and the scan driving control signal SCS, corresponding to synchronization signals supplied from the outside of the organic light emitting display device. The data driving control signal DCS generated in the timing controller 150 is supplied to the data driver 120, and the scan driving control signal SCS generated in the timing controller 150 is supplied to the scan driver 110. The timing controller 150 supplies data Data supplied from the outside to the data driver 120.

The timing controller 150 controls the initialization power unit 160, corresponding to a user's signal, an external light signal sensed in a sensing unit, etc.

The initialization power unit 160 generates a first initialization voltage Vint1, a second initialization voltage Vint2 and a third initialization voltage Vint3. Here, the first initialization voltage Vint1 may be supplied to the red and green sub-pixels. The second initialization voltage Vint2 may be supplied to the first blue sub-pixel, and the third initialization voltage Vint3 may be supplied to the second blue sub-pixel. Additionally, the initialization power unit 160 may control the second and third initialization voltages Vint2 and Vint3 so that the first blue sub-pixel and/or the second blue sub-pixel becomes an emission state and/or a non-emission state, under the control of the timing controller 150.

For example, the initialization power unit 160 may supply a high voltage as the second initialization voltage Vint2 and a low voltage as the third initialization voltage Vint3 under the control of the timing controller 150. Here, the high voltage refers to a voltage higher than the data signal, and the low voltage refers to a voltage lower than the data signal.

When the high voltage as the second initialization voltage Vint2 is supplied, the first blue sub-pixel may be set in the non-emission state, regardless of the data signal. When the low voltage as the third initialization voltage Vint3 is supplied, the second blue sub-pixel may generate light with a specific luminance, corresponding to the data signal.

Figure 2A:
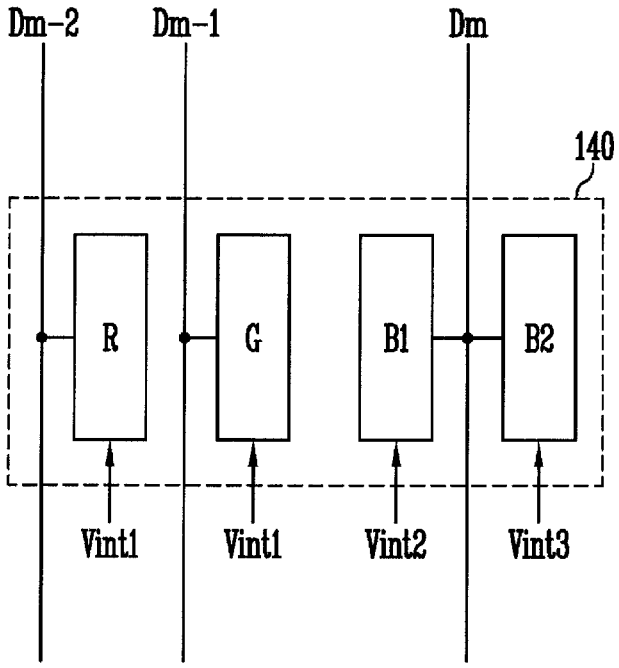
FIGS. 2A and 2B are schematic diagrams illustrating a pixel according to an embodiment of the present invention.
Figure 2B:
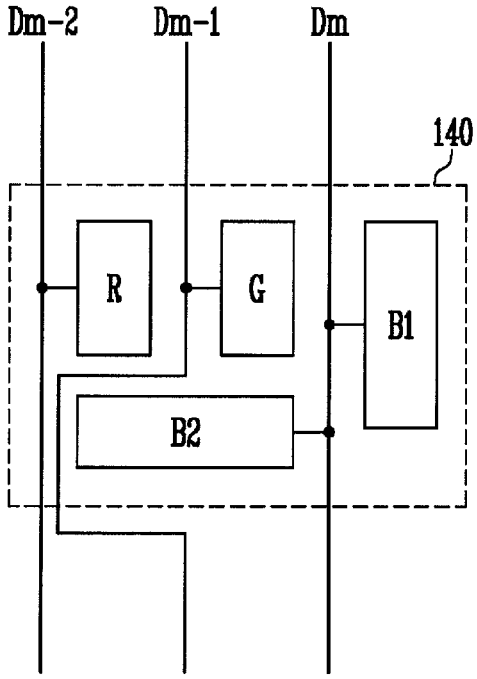

FIGS. 2A and 2B are schematic diagrams illustrating a pixel according to an embodiment of the present invention.

Referring to FIGS. 2A and 2B, the pixel 140 according to this embodiment includes a red sub-pixel R, a green sub-pixel G, a first blue sub-pixel B1 and a second blue sub-pixel B2. In other embodiments, the sub-pixels R, G, B1 and B2 may have various suitable configurations in the area of the pixel 140.

The red sub-pixel R includes a red organic light emitting diode, and generates red light corresponding to the data signal. The red sub-pixel R initializes the voltage at the gate electrode of the driving transistor, using the first initialization voltage Vint1.

The green sub-pixel G includes a green organic light emitting diode, and generates green light corresponding to the data signal. The green sub-pixel G initializes the voltage at the gate electrode of the driving transistor, using the first initialization voltage Vint1.

The first blue sub-pixel B1 includes a first blue organic light emitting diode formed of a sky blue (or light blue) organic light emitting material, and generates blue light corresponding to the data signal. The first blue sub-pixel B1 initializes the voltage at the gate electrode of the driving transistor, using the second initialization voltage Vint2.

In some embodiments, the second blue sub-pixel B2 includes a second blue organic light emitting diode formed of a deep blue (or dark blue) organic light emitting material, and generates blue light corresponding to the data signal. The second blue sub-pixel B2 initializes the voltage at the gate electrode of the driving transistor, using the third initialization voltage Vint3. Here, the first and second blue sub-pixels B1 and B2 included in the same pixel 140 are coupled to the same data line Dm.

The first blue sub-pixel B1 including the first blue organic light emitting diode may be driven with low power consumption due to its high efficiency. The first blue organic light emitting diode may emit light with high luminance, and accordingly, the visibility of the first blue organic light emitting diode may be increased in a bright environment (e.g., daytime).

Figure 3:
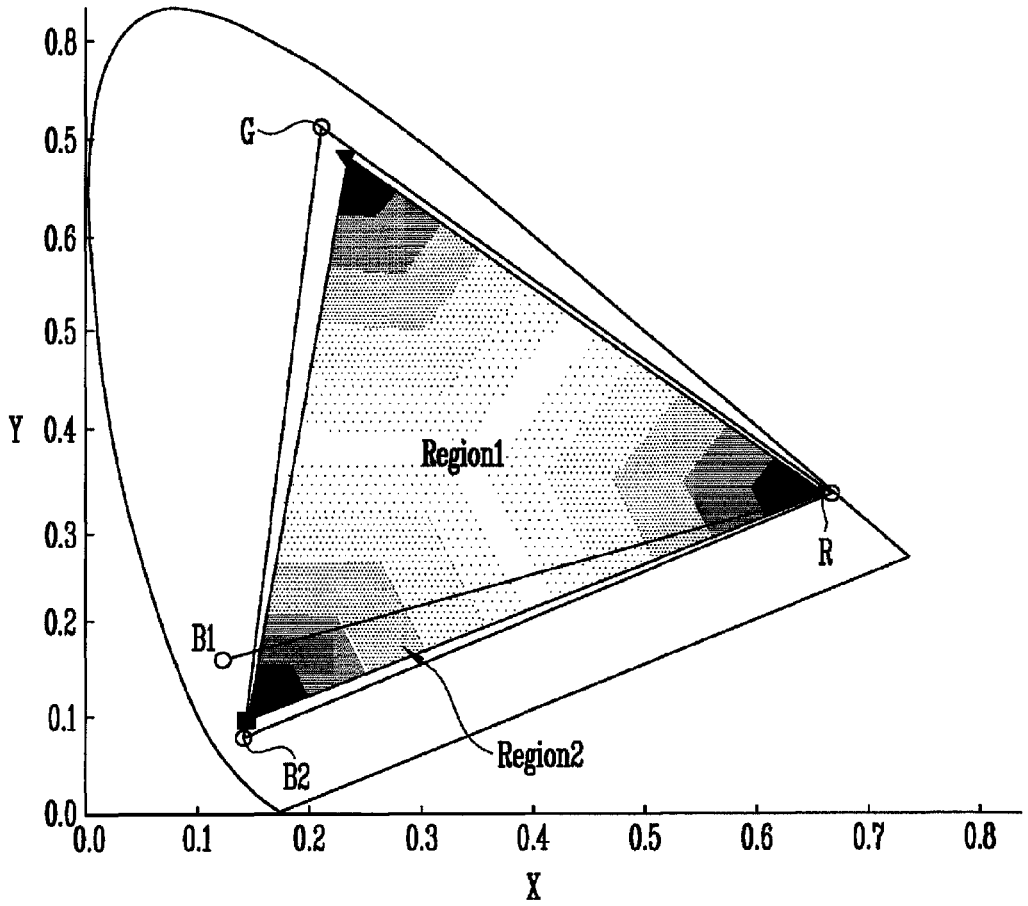
FIG. 3 illustrates color coordinates showing emission regions of first and second organic light emitting diodes.

The second blue sub-pixel B2 including the second blue organic light emitting diode may have increased (or high) color reproducibility. For example, as shown in the color coordinates of FIG. 3, the first blue organic light emitting diode displays colors in first region Region1. On the other hand, the second blue organic light emitting diode may express colors in first and second regions Region1 and Region2. Thus, the second blue organic light emitting diode may implement an image with increased quality, which may be more comfortable for a user's eyes in a dark environment (e.g., night).

Figure 4:
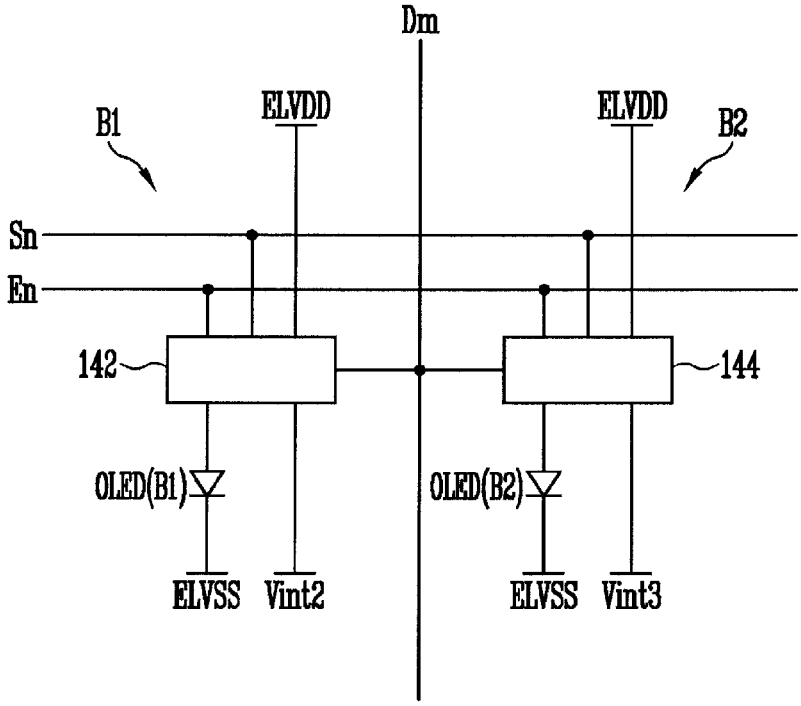
FIG. 4 is a schematic diagram illustrating an embodiment of the structure of blue sub-pixels.

FIG. 4 is a schematic diagram illustrating an embodiment of the structure of blue sub-pixels. For convenience of illustration, a sub-pixel coupled to an n-th scan line Sn and an m-th data line Dm will be shown in FIG. 4.

Referring to FIG. 4, the first blue sub-pixel B1 includes a first pixel circuit 142 and a first blue organic light emitting diode OLED(B1). In some embodiments, the first pixel circuit 142 initializes the voltage at a gate electrode of a driving transistor, using the second initialization voltage Vint2.

The second blue sub-pixel B2 includes a second pixel circuit 144 and a second blue organic light emitting diode OLED(B2). In some embodiments, the second pixel circuit 144 initializes the voltage at a gate electrode of a driving transistor, using the third initialization voltage Vint3.

In some embodiments, the first and second pixel circuits 142 and 144 are implemented with the same circuit, and allow the driving transistor to be diode-coupled during a period in which a data signal is supplied. Practically, in embodiments of the present invention, the first and second pixel circuits 142 and 144 may be implemented with various types of circuits which receive the initialization voltages Vint2 and Vint3. The first and second pixel circuits 142 and 144 adjacent to each other are coupled to the same data line Dm.

Additionally, the pixel circuits respectively included in the red and green sub-pixels R and G may also be implemented with the same circuit as the first and second pixel circuits 142 and 144.

Figure 5:
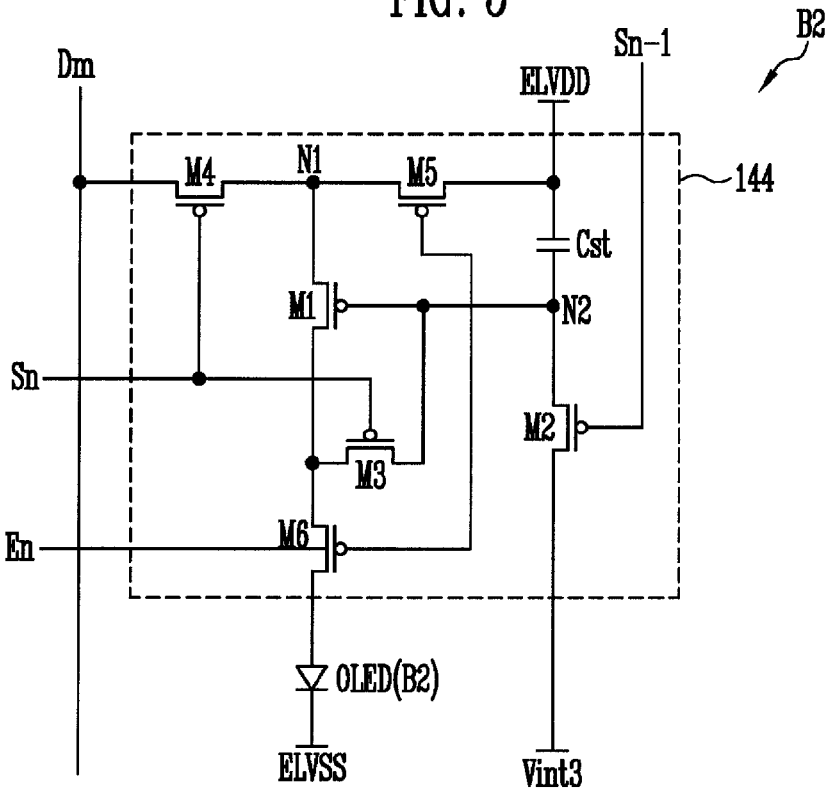
FIG. 5 is a circuit diagram illustrating the structure of a second pixel circuit according to an embodiment of the present invention.

FIG. 5 is a circuit diagram illustrating the structure of a second pixel circuit according to an embodiment of the present invention.

Referring to FIG. 5, the second pixel circuit 144 according to this embodiment includes first to sixth transistors M1 to M6.

A first electrode of the fourth transistor M4 is coupled to the data line Dm, and a second electrode of the fourth transistor M4 is coupled to a first node N1. A gate electrode of the fourth transistor M4 is coupled to the n-th scan line Sn. The fourth transistor M4 is turned on when a scan signal is supplied to the n-th scan line Sn (e.g., a current scan line), to supply a data signal from the data line Dm to the first node N1.

A first electrode of the first transistor (e.g., the driving transistor) M1 is coupled to the first node N1, and a second electrode of the first transistor M1 is coupled to a first electrode of the sixth transistor M6. A gate electrode of the first transistor M1 is coupled to a second node N2. The second transistor M2 controls the amount of current flowing from the first power source ELVDD to the second power source ELVSS via an organic light emitting diode OLED (B2), corresponding to a voltage charged in a storage capacitor Cst.

A first electrode of the second transistor M2 is coupled to the second node N2, and a second electrode of the second transistor M2 is coupled to the third initialization voltage Vint3. A gate electrode of the second transistor M2 is coupled to an (n−1)-th scan line Sn−1. The second transistor M2 is turned on when the scan signal is supplied to the (n−1)-th scan line Sn−1 (e.g., a previous scan line), to supply the third initialization voltage Vint3 to the second node N2. That is, when the scan signal is supplied to the (n−1)-th scan line Sn−1, a high or low third initialization voltage Vint3 is supplied to the second node N2.

A first electrode of the third transistor M3 is coupled to the second electrode of the first transistor M1, and a second electrode of the third transistor M3 is coupled to the second node N2. A gate electrode of the third transistor M3 is coupled to the n-th scan line Sn. The third transistor M3 is turned on when the scan signal is supplied to the n-th scan line Sn, to allow the first transistor M1 to be diode-coupled.

A first electrode of the fifth transistor M5 is coupled to the first power source ELVDD, and a second electrode of the fifth transistor M5 is coupled to the first node N1. A gate electrode of the fifth transistor M5 is coupled to an emission control line En. The fifth transistor M5 is turned off when an emission control signal is supplied to the emission control line En, and is turned on when the emission control signal is not supplied. For example, the emission control signal is a logic high signal in this embodiment.

The first electrode of the sixth transistor M6 is coupled to the second electrode of the first transistor M1, and a second electrode of the sixth transistor M6 is coupled to an anode electrode of the organic light emitting diode OLED(B2). A gate electrode of the sixth transistor M6 is coupled to the emission control line En. The sixth transistor M6 is turned off when the emission control signal is supplied to the emission control line En, and is turned on when the emission control signal is not supplied.

Figure 6:
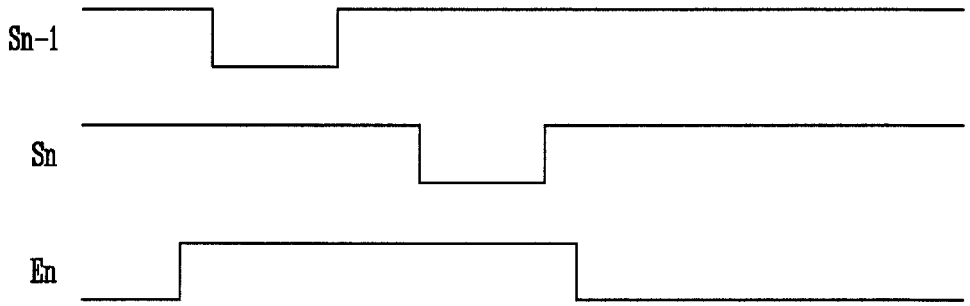
FIG. 6 is a waveform diagram illustrating an embodiment of a method of driving the pixel circuit shown in FIG. 5.

FIG. 6 is a waveform diagram illustrating an embodiment of a method of driving the pixel circuit shown in FIG. 5.

Referring to FIG. 6, the emission control signal is first supplied to the emission control line En so that the fifth and sixth transistors M5 and M6 are turned off. When the fifth transistor M5 is turned off, the first power source ELVDD and the first node N1 are electrically decoupled from each other. When the sixth transistor M6 is turned off, the first transistor M1 and the organic light emitting diode OLED (B2) are electrically decoupled from each other. That is, the sub-pixel B2 is set in the non-emission state during a period in which the emission control signal is supplied.

Subsequently, the scan signal is supplied to the (n−1)-th scan line Sn−1. When the scan signal is supplied to the (n−1)-th scan line Sn−1, the second transistor M2 is turned on. When the second transistor M2 is turned on, the third initialization voltage Vint3 is supplied to the second node N2.

After the third initialization voltage Vint3 is supplied to the second node N2, the scan signal is supplied to the n-th scan line Sn so that the third and fourth transistors M3 and M4 are turned on. When the third transistor M3 is turned on, the first transistor M1 is diode-coupled. When the fourth transistor M4 is turned on, the data signal from the data line Dm is supplied to the first node N1.

In a case where the low third initialization voltage Vint3 is supplied to the second node N2, the first transistor M1 is turned on, and accordingly, a voltage corresponding to the data signal and the threshold voltage of the first transistor M1 is applied to the second node N2. In this case, the storage capacitor Cst is charged with the voltage applied to the second node N2.

In a case where the high third initialization voltage Vint3 is supplied to the second node N2, the first transistor M1 maintains the turn-off state. In this case, the storage capacitor Cst maintains the charging state of the high third initialization voltage Vint3.

That is, when the low third initialization voltage Vint3 is supplied to the (n−1)-th scan line Sn−1 during a period in which the scan signal is supplied, the storage capacitor Cst is charged with a voltage corresponding to the threshold voltage of the first transistor M1 and the data signal. When the high third initialization voltage Vint3 is supplied to the (n−1)-th scan line Sn−1 during the period in which the scan signal is supplied, the storage capacitor Cst is charged with a voltage corresponding to the high third initialization voltage Vint3. Here, in some embodiments, the high third initialization voltage Vint3 is set as a voltage higher than the data signal, and accordingly, the first transistor M1 is set in the turn-off state.

After the voltage is charged in the storage capacitor Cst, the supply of the emission control signal to the emission control line En is stopped so that the fifth and sixth transistors M5 and M6 are turned on. When the fifth transistor M5 is turned on, the first power source ELVDD and the first node N1 are electrically coupled to each other. When the sixth transistor M6 is turned on, the first transistor M1 and the organic light emitting diode OLED(B2) are electrically coupled to each other.

When the second node N2 is set to the third initialization voltage Vint3, the first transistor M1 maintains the turn-off state. When the second node N2 is set to a voltage corresponding to the data signal, the first transistor M1 controls the amount of current flowing from the first power source ELVDD to the second power source ELVSS via the organic light emitting diode OLED(B2), corresponding to the voltage of the data signal.

Figure 7:
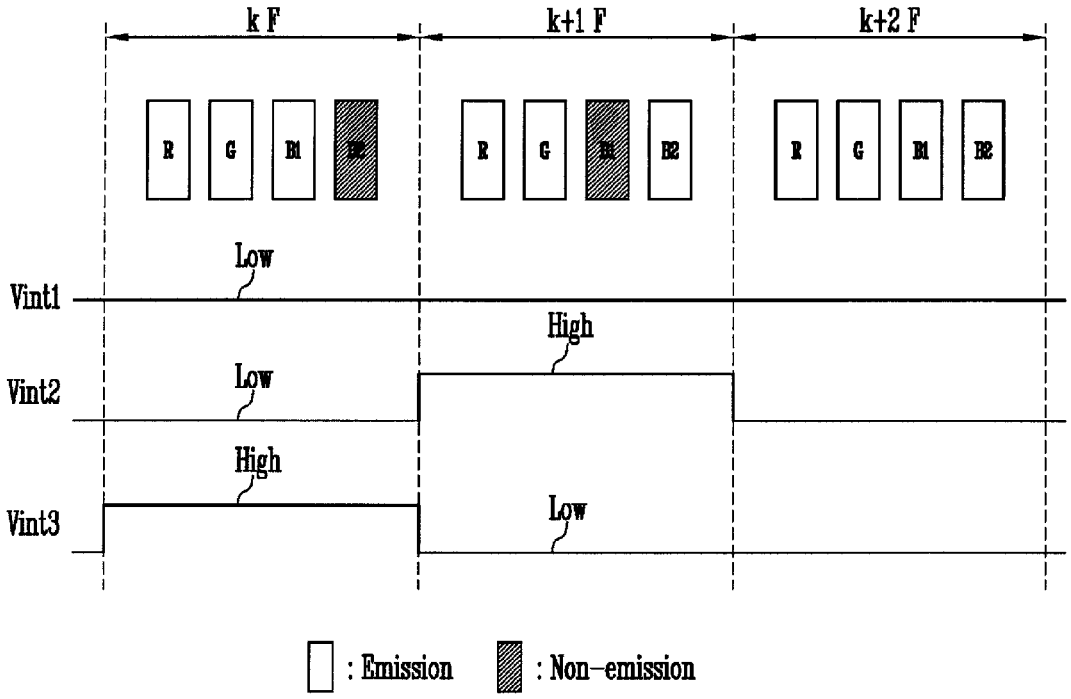
FIG. 7 is a diagram illustrating a process of supplying an initialization power source according to an embodiment of the present invention.

FIG. 7 is a diagram illustrating a process of supplying an initialization power source according to an embodiment of the present invention.

Referring to FIG. 7, the initialization power unit 160 supplies a low first initialization Vint1 to the red and green sub-pixels R and G. The initialization power unit 160 supplies a low second initialization voltage Vint2 and a high initialization voltage Vint3 during a k-th (k is a natural number) frame. Then, during the k-th frame, the first blue sub-pixel B1 generates light corresponding to a data signal, and the second blue sub-pixel B2 maintains the non-emission state, regardless of the data signal.

Subsequently, the initialization power unit 160 supplies a high second initialization voltage Vint2 and a low third initialization voltage Vint3 during a (k+1)-th frame. Then, during the (k+1)-th frame, the first blue sub-pixel B1 is set in the non-emission state, and the second blue sub-pixel B2 generates light corresponding to the data signal.

The initialization power unit 160 supplies the low second initialization voltage Vint2 and the low third initialization voltage Vint3 during a (k+2)-th frame. Then, during the (k+2)-th frame, the first and second blue sub-pixels B1 and B2 generate light corresponding to the data signal.

As described above, in embodiments of the present invention, the initialization power unit 160 may control the emission and non-emission of the first and second blue sub-pixels B1 and B2 by controlling the second and third initialization voltages Vint2 and Vint3. Thus, in embodiments of the present invention, the presence of emission of the first blue sub-pixel B1 and/or the second blue sub-pixel B2 may be controlled, in consideration of power consumption, color reproducibility, emission efficiency, etc.

For example, in embodiments of the present invention, the first and second blue sub-pixels B1 and B2 may selectively emit light, corresponding to an external environment (e.g., night or daytime). In other words, the initialization power unit 160 may control the second and third initialization voltages Vint2 and Vint3 under the control of the timing controller 150 so that the first blue sub-pixel B1 emits light in a bright environment. The initialization power unit 160 may control the second and third initialization voltages Vint2 and Vint3 under the control of the timing controller 150 so that the second blue sub-pixel B2 emits light in a dark environment.

Although it has been described in embodiments of the present invention that the transistors are shown as PMOS transistors for convenience of illustration, embodiments of the present invention are not limited thereto. In other words, the transistors may be formed as NMOS transistors.

By way of summation and review, in a general organic light emitting display device, a current corresponding to a data signal is supplied to an organic light emitting diode, using a transistor formed in each pixel, so that light is generated in the organic light emitting diode.

In the organic light emitting display device, red, green and blue lights are mixed using a pixel including red, green and blue sub-pixels, thereby expressing (or generating) a color. To this end, the red sub-pixel includes a red organic light emitting diode configured to generate red light, a green organic light emitting diode configured to generate green light, and a blue organic light emitting diode configured to generate blue light.

However, the lifespan, power consumption and color reproducibility of the organic light emitting display device may be lowered by the material property of the blue organic light emitting diode. Practically, in a case where a sky blue organic light emitting material is used for the blue organic light emitting diode, the power consumption and lifespan of the organic light emitting display device may be improved due to high efficiency. However, when the sky blue organic light emitting material is used, the color reproducibility of the organic light emitting display device may be lowered, and therefore, high image quality may not be expected. In a case where a deep blue organic light emitting material is used for the blue organic light emitting diode, the color reproducibility of the organic light emitting display device may be increased, thereby improving image quality. However, when the deep blue organic light emitting material is used, the power consumption may be high and the lifespan may be short due to low efficiency.

In the organic light emitting display device and the method of driving the same according to embodiments of the present invention, the first and second blue sub-pixels may be selectively used in consideration of power consumption, color reproducibility, etc., thereby increasing (or improving) image quality.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and equivalents thereof.

What is claimed is:

1. An organic light emitting display device comprising:

a plurality of pixels, each comprising a red sub-pixel, a green sub-pixel, a first blue sub-pixel and a second blue sub-pixel; and an initialization power source configured to supply a first initialization voltage to the red sub-pixel and to the green sub-pixel, to supply a second initialization voltage to the first blue sub-pixel, and to supply a third initialization voltage to the second blue sub-pixel, wherein the first and second blue sub-pixels are adjacent to each other and are coupled to a same data line.

2. The organic light emitting display device of claim 1, wherein each of the red sub-pixel, the green sub-pixel, the first blue sub-pixel and the second blue sub-pixel comprises a driving transistor comprising a gate electrode configured to receive any one of the plurality of initialization voltages before a data signal is supplied.

3. The organic light emitting display device of claim 2, wherein the first initialization voltage is a voltage that is lower than the data signal.

4. The organic light emitting display device of claim 2, wherein the initialization power source is configured to supply a low second initialization voltage that is lower than the data signal, or a high second initialization voltage that is higher than the data signal.

5. The organic light emitting display device of claim 2, wherein the initialization power source is configured to supply a low third initialization voltage that is lower than the data signal, or a high third initialization voltage that is higher than the data signal.

6. The organic light emitting display device of claim 1, wherein the first blue sub-pixel comprises an organic light emitting diode formed of a sky blue organic light emitting material.

7. The organic light emitting display device of claim 1, wherein the second blue sub-pixel comprises an organic light emitting diode formed of a deep blue organic light emitting material.

8. The organic light emitting display device of claim 1, further comprising:

a scan driver configured to supply a scan signal to a plurality of scan lines coupled to the pixels at respective horizontal lines and supply an emission control signal to a plurality of emission control lines; and a data driver configured to supply a data signal to a plurality of data lines coupled to the pixels at respective vertical lines.

9. The organic light emitting display device of claim 8, wherein each of the red sub-pixel, the green sub-pixel, the first blue sub-pixel and the second blue sub-pixel comprises:

an organic light emitting diode configured to generate light of a corresponding one of red, green and blue; and a pixel circuit configured to control an amount of current supplied to the organic light emitting diode.

10. The organic light emitting display device of claim 9, wherein each pixel circuit comprises:

a driving transistor configured to control an amount of current flowing through the organic light emitting diode from a first power source coupled to the driving transistor via a first node;

a second transistor coupled between a gate electrode of the driving transistor and the initialization power source, the second transistor being configured to turn on when the scan signal is supplied to a previous scan line of the plurality of scan lines;

a third transistor coupled between the gate electrode and a second electrode of the driving transistor, the third transistor being configured to turn on when the scan signal is supplied to a current scan line of the plurality of scan lines; and a fourth transistor coupled between the first node and a data line of the plurality of data lines, the fourth transistor being configured to turn on when the scan signal is supplied to the current scan line.

11. The organic light emitting display device of claim 10, wherein each pixel circuit further comprises:

a fifth transistor coupled between the first node and the first power source, the fifth transistor being configured to turn off when the emission control signal is supplied to a current emission control line of the plurality of emission control lines; and a sixth transistor coupled between the second electrode of the driving transistor and the organic light emitting diode, the sixth transistor being configured to turn off when the emission control signal is supplied to the current emission control line.

12. The organic light emitting display device of claim 11, wherein the emission control signal supplied to the current emission control line overlaps with the scan signal supplied to the previous scan line and the current scan line.

13. A method of driving an organic light emitting display device which comprises a pixel comprising a red sub-pixel, a green sub-pixel, a first blue sub-pixel and a second blue sub-pixel, the method comprising:

controlling whether or not the first and second blue sub-pixels sharing a data line emit light;

supplying a data signal to the red sub-pixel, the green sub-pixel, the first blue sub-pixel and the second blue sub-pixel;

allowing the sub-pixel set in an emission state, by including the red and green sub-pixels, to emit light, corresponding to the data signal; and supplying a first initialization voltage to the red and green sub-pixels, a second initialization voltage to the first blue sub-pixel, and a third initialization voltage to the second blue sub-pixel.

14. The method of claim 13, wherein the first blue sub-pixel comprises an organic light emitting diode formed of a sky blue organic light emitting material.

15. The method of claim 13, wherein the second blue sub-pixel comprises an organic light emitting diode formed of a deep blue organic light emitting material.

16. The method of claim 13, wherein each of the red sub-pixel, the green sub-pixel, the first blue sub-pixel and the second blue sub-pixel comprises a driving transistor diode-coupled during a period in which the data signal is supplied.

17. The method of claim 16, wherein the controlling comprises:

supplying, to a gate electrode of the driving transistor of the first blue sub-pixel, a high second initialization voltage higher than the data signal or a low second initialization voltage lower than the data signal, before the data signal is supplied; and supplying, to a gate electrode of the driving transistor of the second blue sub-pixel, a high third initialization voltage higher than the data signal or a low third initialization voltage lower than the data signal, before the data signal is supplied.

* * * * *